US010191424B2

(12) United States Patent
Shimura et al.

(10) Patent No.: US 10,191,424 B2
(45) Date of Patent: Jan. 29, 2019

(54) IMAGE FORMING APPARATUS FOR CONTROLLING SWITCHING FROM MONOCHROME IMAGE FORMING MODE TO COLOR IMAGE FORMING MODE

(71) Applicant: CANON KABUSHIKI KAISHA, Tokyo (JP)

(72) Inventors: Hiromi Shimura, Toride (JP); Hiroto Nishihara, Tsukuba (JP); Keita Takahashi, Abiko (JP); Shinnosuke Iwadate, Toride (JP); Teruhito Kai, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/620,002

(22) Filed: Jun. 12, 2017

(65) Prior Publication Data

US 2017/0364009 A1 Dec. 21, 2017

(30) Foreign Application Priority Data

Jun. 21, 2016 (JP) ..... 2016-122988

(51) Int. Cl.
*G03G 15/00* (2006.01)
*G03G 15/01* (2006.01)

(52) U.S. Cl.
CPC ..... *G03G 15/50* (2013.01); *G03G 15/01* (2013.01); *G03G 15/0136* (2013.01)

(58) Field of Classification Search
CPC ..... G03G 15/50; G03G 15/01
USPC ..... 399/82
See application file for complete search history.

(56) References Cited

U.S. PATENT DOCUMENTS

| | | | | |
|---|---|---|---|---|
| 7,420,583 | B2 | 9/2008 | Sato et al. | |
| 9,324,010 | B2 | 4/2016 | Iwadate et al. | |
| 2002/0080220 | A1* | 6/2002 | Arai | G03G 15/01 347/115 |
| 2003/0194247 | A1* | 10/2003 | Motoyama | H04N 1/00005 399/82 |

OTHER PUBLICATIONS

U.S. Appl. No. 15/606,259, Keita Takahashi Shinnosuke Iwadate Teruhito Kai Hiroto Nishihara Hiromi Shimura, filed May 26, 2017.

* cited by examiner

*Primary Examiner* — Billy James M Lactaoen
(74) *Attorney, Agent, or Firm* — Venable LLP

(57) ABSTRACT

Provided is an image forming apparatus capable of reducing a downtime for switching between a monochrome image forming mode and a color image forming mode. In the image forming apparatus, images formed by a plurality of image forming stations are transferred in superimposition onto a transfer member. Further, the image forming apparatus controls image formation in each of a first mode of performing image formation using only an image forming station located at the most downstream position in a moving direction of the transfer member among the plurality of image forming stations, and a second mode of performing image formation using the plurality of image forming stations.

15 Claims, 6 Drawing Sheets

IMAGE FORMING APPARATUS FOR CONTROLLING SWITCHING FROM MONOCHROME IMAGE FORMING MODE TO COLOR IMAGE FORMING MODE

BACKGROUND OF THE INVENTION

Field of the Invention

The present invention relates to an image forming apparatus employing an electrophotographic system, an electrostatic recording system, or other systems.

Description of the Related Art

A color copying machine including image forming units for a plurality of colors generally has a color image forming mode in which all of the image forming units are activated to form a color image, and a monochrome image forming mode in which only the image forming unit for black is activated to form a monochrome image. Further, when the monochrome image is to be formed, the image forming units for colors other than black are not required to be set in an image formable state. Therefore, the image forming modes are switchable depending on contents of a job input to the copying machine. The "job" herein refers to information for executing a series of image forming operations onto a single sheet or a plurality of sheets based on an instruction to start the image forming operations.

For example, in an image forming apparatus disclosed in U.S. Pat. No. 7,420,583, there is disclosed a technology of reducing a time period required for switching from the monochrome image forming mode to the color image forming mode.

In this image forming apparatus, an operation of preparing for image formation in the color image forming mode is started during the image formation in the monochrome image forming mode, and the image formation in the color image forming mode is started after the image formation in the monochrome image forming mode is ended.

FIG. 6 is a timing chart for illustrating the image forming mode switching operation of the image forming apparatus disclosed in U.S. Pat. No. 7,420,583. In FIG. 6, Y represents a yellow color, M represents a magenta color, C represents a cyan color, and K represents a black color. Further, "IMAGE FORMATION K1" represents the image formation in the monochrome image forming mode, and "IMAGE FORMATION Y2", "IMAGE FORMATION M2", image formation C2, and "IMAGE FORMATION K2" represent the image formation in the color image forming mode. "PREP" represents the operation of preparing for the image formation.

In the image forming apparatus disclosed in U.S. Pat. No. 7,420,583, from an end time ti of the image formation by the image forming unit for black during the monochrome image forming mode, the image forming unit located at the most upstream position in the color image forming mode (in this case, the image forming unit for yellow) starts its image formation. Therefore, the image forming unit for black does not form an image during a period Tw, and there arises a problem in that a downtime (out of operation time) occurs due to the switching of the image forming mode.

The present invention has a primary object to provide an image forming apparatus capable of reducing a downtime due to switching of an image forming mode.

SUMMARY OF THE INVENTION

An image forming apparatus according to the present disclosure includes: an image forming unit comprising a plurality of image forming stations configured to form images of different colors, the image forming unit being capable of operating in a first mode of performing image formation using only a first image forming station for a predetermined color among the plurality of image forming stations, and a second mode of performing image formation using the plurality of image forming stations; and a controller configured to control the image formation in the first mode and the image formation in the second mode, wherein, in a case where the controller determines that switching to the image formation in the second mode occurs after the image formation in the first mode, the controller controls the image forming unit so that a second image forming station, which performs image formation first in the second mode among the plurality of image forming stations, starts a preparation operation of the image formation in the second mode before the first image forming station ends the image formation in the first mode.

Further features of the present invention will become apparent from the following description of exemplary embodiments (with reference to the attached drawings).

DESCRIPTION OF THE EMBODIMENTS

Now, an embodiment of the present invention is described in detail with reference to the drawings. As an example, description is given of a case where the present invention is applied to an image forming apparatus including image forming units for a plurality of colors, and being capable of switching between a monochrome image forming mode (first mode) for forming a monochrome image and a color image forming mode (second mode) for forming a color image. Further, the image forming apparatus includes a plurality of image forming units, and is configured to sequentially transfer images formed by the plurality of image forming units in superimposition onto a transfer member.

Exemplary Embodiment

Figure 1:
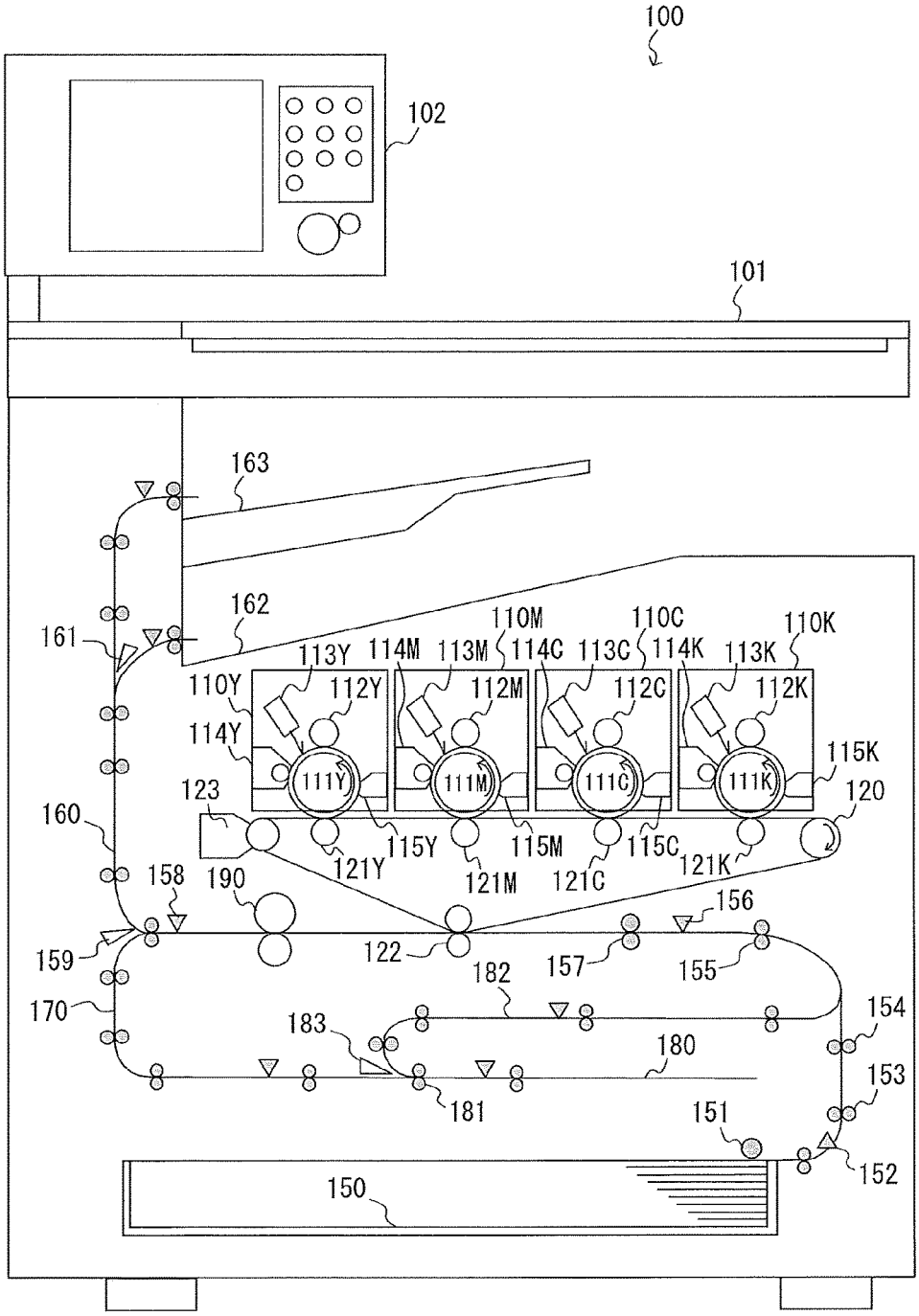
FIG. 1 is a schematic vertical sectional view for illustrating an example of a configuration of an image forming apparatus.
Figure 2:
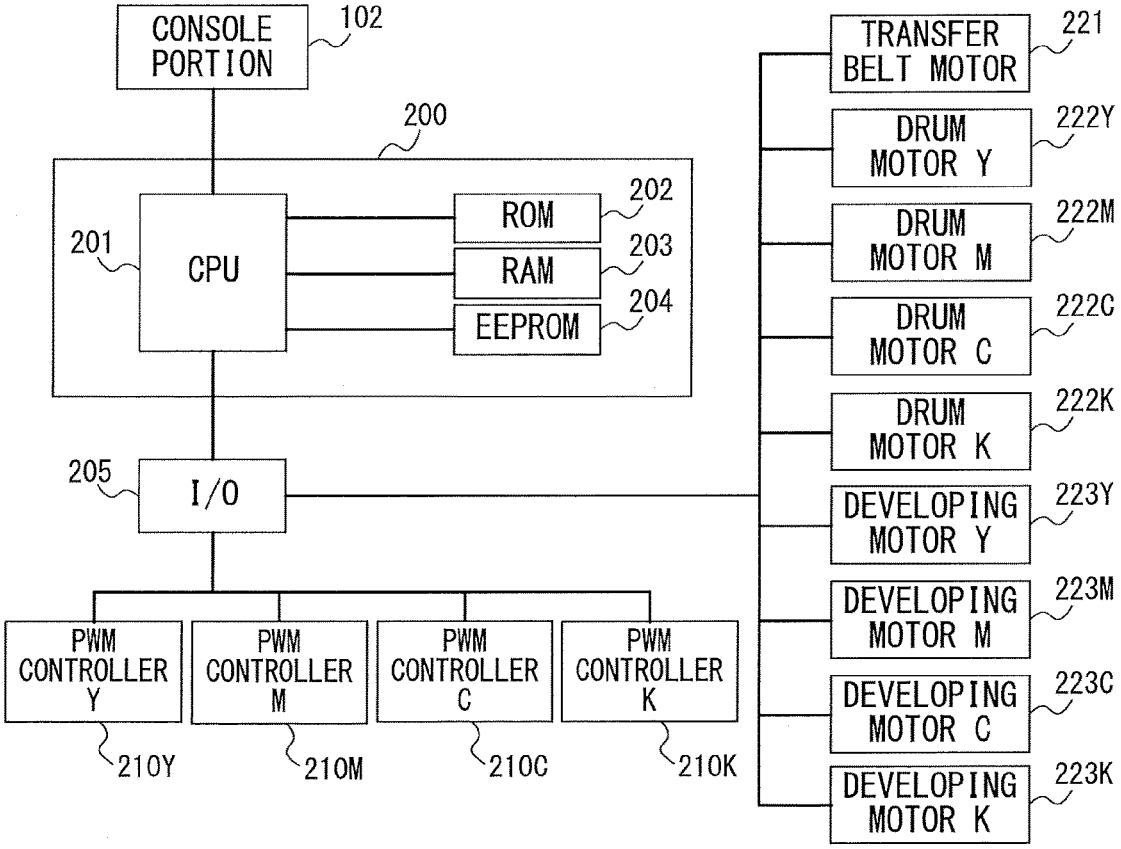
FIG. 2 is a block diagram for illustrating an example of a functional configuration of the image forming apparatus.

FIG. 1 is a schematic vertical sectional view for illustrating an example of a configuration of an image forming apparatus 100 according to this embodiment. Further, FIG. 2 is a block diagram for illustrating an example of a functional configuration of the image forming apparatus 100. With reference to FIG. 1 and FIG. 2, the overall configuration and the basic operation of the image forming apparatus 100 are described.

The image forming apparatus 100 illustrated in FIG. 1 includes a scanner 101 configured to read an original image, and a console portion 102 configured to receive various instructions from a user to enable transmission of various types of information.

The image forming apparatus 100 further includes process units 110Y, 110M, 110C, and 110K configured to form images corresponding to respective colors of yellow, magenta, cyan, and black, an intermediate transfer belt 120, primary transfer rollers 121Y, 121M, 121C, and 121K, a secondary transfer unit 122, and a secondary transfer cleaner 123. The process units corresponding to respective colors correspond to image forming stations corresponding to the respective colors.

The process units 110Y, 110M, 110C, and 110K illustrated in FIG. 1 are units configured to form toner images of yellow, magenta, cyan, and black onto the intermediate transfer belt 120, respectively. The configuration of the process unit is described below with reference to the process unit 110Y as being representative, but the process units for colors other than yellow have similar configurations.

The process unit 110Y for yellow includes a photosensitive drum 111Y, a charging roller 112Y, a laser unit 113Y, a developing device 114Y, and a photosensitive drum cleaner 115Y.

A controller 200 illustrated in FIG. 2 is configured to control various operations of the image forming apparatus 100.

The controller 200 includes a central processing unit (CPU) 201, a read-only memory (ROM) 202, a random access memory (RAM) 203, and an electrically erasable programmable read-only memory (EEPROM) 204.

The CPU 201 is configured to control the image forming apparatus 100 so as to start a printing operation based on the instruction to start the printing operation (hereinafter referred to as "job"), which is received via the console portion 102, for example. The CPU 201 is further configured to control drive of various motors connected via an I/O 205. The CPU 201 is further configured to detect input signals from various sensors connected via the I/O 205.

The CPU 201 is configured to control drive of a drum motor Y 222Y, to thereby rotationally drive the photosensitive drum 111Y and the charging roller 112Y using the drum motor Y 222Y as a drive source. Similarly, the CPU 201 is configured to control drive of a developing motor Y 223Y, to thereby rotationally drive the developing device 114Y.

The CPU 201 is further configured to output an instruction to a pulse-width modulation (PWM) controller Y 210Y via the I/O 205. The PWM controller Y 210Y is configured to control voltages to be applied to the charging roller 112Y, the developing device 114Y, and the primary transfer roller 121Y through PWM control based on the received instruction. The CPU 201 is further configured to control the laser light amount of the laser unit 113Y. The CPU 201 is further configured to control a heater of a fixing device 190 via the I/O 205.

Next, the basic printing operation is described with reference to FIG. 1 and FIG. 2.

The image forming apparatus 100 starts the printing operation based on the job contents when the job is received via the console portion 102. The image forming apparatus 100 drives a motor (not shown) serving as a drive source of a sheet feeding pick-up roller 151 to rotationally drive the sheet feeding pick-up roller 151. Thus, sheets received in a sheet feeding cassette 150 are fed and conveyed one by one. At this time, the image forming apparatus 100 uses a sheet feeding pick-up sensor 152 to monitor whether or not the sheet feeding operation is normally performed.

Meanwhile, the image forming apparatus 100 starts an operation of preparing for image formation (hereinafter referred to as "image formation preparation") and the image formation in synchronization with the timing at which the sheet arrives at the secondary transfer unit 122.

First, the image forming apparatus 100 drives the drum motor Y 222Y, a drum motor M 222M, a drum motor C 222C, a drum motor K 222K, and a transfer belt motor 221 to rotate the photosensitive drums 111Y, 111M, 111C, and 111K and the intermediate transfer belt 120.

Next, in a case where the job contents correspond to an instruction to form a color image, the image forming mode of the image forming apparatus 100 is set to the color image forming mode. In this case, the image formation preparation operation is sequentially started from the process unit 110Y for yellow, which is located at the most upstream position in a moving direction of the intermediate transfer belt 120. The image formation preparation of each of the process units downstream of the process unit for yellow is started by delaying the timing by a time period corresponding to a distance between the process units (distance between the image forming element located at the most upstream position and the image forming element located at the most downstream position).

For example, it is assumed that the time period corresponding to the distance between the process units is 300 milliseconds. In this case, in the color image forming mode, an image can be formed in all of the four colors after an elapse of 900 milliseconds from when the image formation preparation operation for yellow is ended.

Meanwhile, in a case where the job contents correspond to an instruction to form a monochrome image, the monochrome image forming mode is set, and only the process unit 110K for black starts the image formation preparation operation. In the monochrome image forming mode, an image can be formed only in one color of black.

Now, the image formation preparation operation is described. A description is given here with reference to the process unit for yellow in the color image forming mode as a representative process unit. The preparation operations of the process units for other colors are similar to the preparation operation of the process unit for yellow except that the start timing is delayed by the time period corresponding to the distance between the process units.

In the image formation preparation operation, first, the CPU 201 outputs an instruction to the PWM controller Y 210Y, to thereby apply a charging bias to the charging roller 112Y to charge the photosensitive drum 111Y. Then, at a timing at which the sufficiently-charged position on the photosensitive drum 111Y reaches the position of the developing device 114Y, the developing motor Y 223Y is driven to rotate the developing device 114Y. Further, in synchronization therewith, the CPU 201 outputs an instruction to the PWM controller Y 210Y to apply a developing bias to the developing device 114Y. Such series of processing is performed to complete the image formation preparation operation.

It is assumed that, for example, a time period of 100 milliseconds is required for the photosensitive drum 111Y to be sufficiently charged after the charging bias is applied to the charging roller 112Y. Further, it is assumed that a time period of 100 milliseconds is required for the charged portion to move from the position of the charging roller 112Y to the position of the developing device 114Y. That is, in this case, a total time period of 200 milliseconds (preparation operation time period) is required until completion of the image formation preparation operation.

Next, the image formation is described. A description is given here with reference to image formation of the process unit for yellow as a representative process unit, but the image formation of the process units for other colors is similar to that of the process unit for yellow except that the timing is delayed by the time period corresponding to the distance between the process units.

After the image formation preparation is completed, the laser unit 112Y starts laser irradiation to form a latent image on the photosensitive drum 111Y. Then, the formed latent image is developed on the photosensitive drum 111Y using toner in the developing device 114Y. After that, the toner image developed on the photosensitive drum 111Y is applied with a primary transfer voltage by the primary transfer roller 121Y to be transferred onto the intermediate transfer belt 120. Toner images of other colors are similarly formed, and are transferred in superimposition onto the intermediate transfer belt 120.

The toner images transferred onto the intermediate transfer belt 120 are conveyed to the secondary transfer unit 122 through rotation of the intermediate transfer belt 120. Meanwhile, the toner remaining on the photosensitive drum 111Y without being transferred onto the intermediate transfer belt 120 is collected by the photosensitive drum cleaner 115Y.

Further, a pre-registration conveyance sensor 156 detects the position of the sheet conveyed by conveyance rollers A 153, conveyance rollers B 154, and conveyance rollers C 155. Then, the conveyance of the sheet is controlled so that, considering the timing at which a leading edge of the sheet arrives at the pre-registration conveyance sensor 156, the leading edge of the sheet and a leading end of the toner image on the intermediate transfer belt 120 match each other at the secondary transfer unit 122. For example, the conveyance of the sheet is controlled so that, in a case where the sheet arrives earlier than the toner image, the sheet is stopped for a predetermined time period by pre-registration conveyance rollers 157, and then the conveyance is restarted.

The toner image is transferred onto the sheet through application of a secondary transfer voltage to the sheet and the toner image that have arrived at the secondary transfer unit 122 as described above. Toner remaining on the intermediate transfer belt 120 without being transferred onto the sheet is collected by the secondary transfer cleaner 123.

The sheet subjected to transfer is conveyed to the fixing device 190. The fixing device 190 heats and fixes the toner image formed on the sheet onto the sheet. After that, the sheet is conveyed to a further downstream position in the apparatus.

When the leading edge of the sheet subjected to fixing arrives at a sheet conveyance sensor 158, the conveyance direction of the sheet is switched by a conveyance flapper A 159 based on the job contents, and the sheet is conveyed toward any one of a sheet delivery conveyance path 160 and a duplex-printing conveyance path 170.

The sheet conveyed to the sheet delivery conveyance path 160 is conveyed further downstream by a plurality of sheet delivery conveyance rollers, and is conveyed toward a sheet delivery port 162 and a sheet delivery port 163. Then, a conveyance flapper 161 is switched based on the instructed job contents, to thereby output the sheet to any one of the sheet delivery ports.

Meanwhile, during duplex printing, the sheet travels through the duplex-printing conveyance path 170, and is directly conveyed to a duplex-printing reverse conveyance path 180 by a plurality of conveyance rollers. After that, when the trailing edge of the sheet passes over duplex-printing conveyance rollers 181, a duplex-printing reverse flapper 183 is switched to a direction of a duplex-printing sheet re-feeding path 182, and rotational drive is reversely performed. After that, the sheet is conveyed by a plurality of conveyance rollers to be passed to the conveyance rollers C 155 again.

Further, in a case where the job contents correspond to a job of performing printing of a plurality of sheets, after a standby time period of 100 milliseconds, sheet feeding conveyance, image formation, transfer, fixing, and sheet delivery or duplex-printing conveyance are continuously executed. When the job is entirely ended, the console portion 102 displays that the job is ended.

The above-mentioned basic printing operation is merely an example, and the present invention is not limited to the above-mentioned configuration.

Image Forming Mode Switching Operation

Figure 3A:
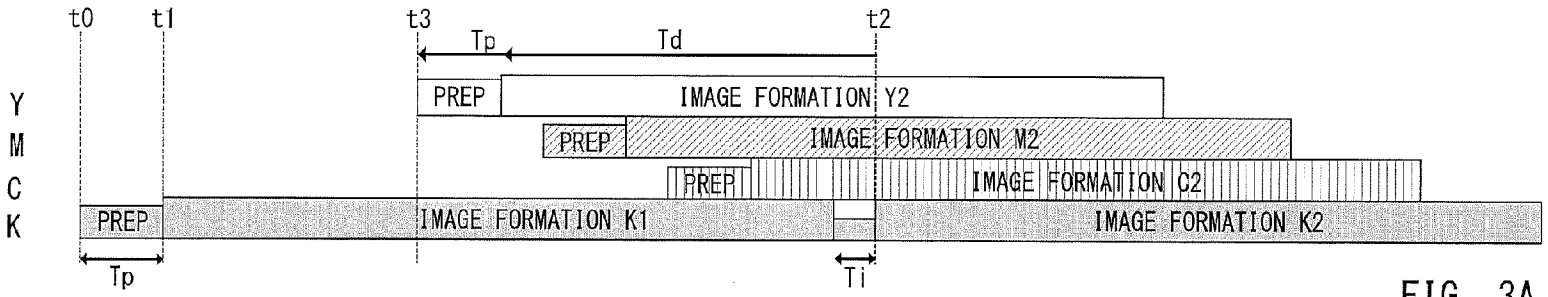
FIG. 3A, FIG. 3B, and FIG. 3C are timing charts for schematically illustrating an operation of switching from a monochrome image forming mode to a color image forming mode in the image forming apparatus.
Figure 3B:
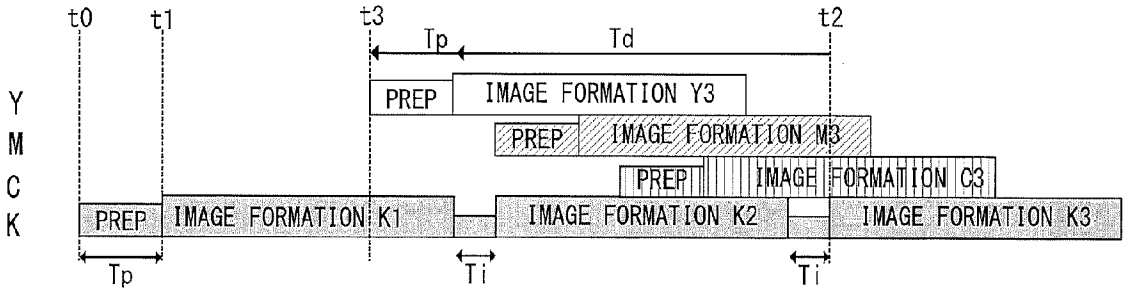
Figure 3C:
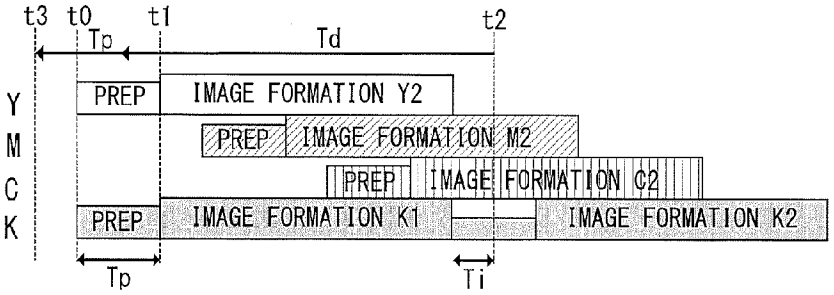

FIG. 3A, FIG. 3B, and FIG. 3C are timing charts for schematically illustrating the operation of switching from the monochrome image forming mode to the color image forming mode in the image forming apparatus 100.

FIG. 3A, FIG. 3B, and FIG. 3C are charts for illustrating three patterns based on the difference in time period required for the last image formation in the image formation of a plurality of sheets in the monochrome image forming mode, and on the difference in the number of sheets that are successively formed in the monochrome image forming mode. With reference to FIG. 3A, FIG. 3B, and FIG. 3C, the overview of the image forming mode switching operation of the image forming apparatus 100 is described. The detailed control method in the image forming mode switching operation is described later with reference to FIG. 4 and FIG. 5.

In FIG. 3A, FIG. 3B, and FIG. 3C, the portion of "PREP" represents that the image formation preparation for the corresponding color is performed. Further, the portion of "IMAGE FORMATION K1" or the like represents that the image formation for the corresponding color is performed. In FIG. 3A, FIG. 3B, and FIG. 3C, Y represents a yellow color, M represents a magenta color, C represents a cyan color, and K represents a black color.

Further, in FIG. 3A and FIG. 3C, image formation K1 represents the image formation in the monochrome image forming mode, and image formation Y2, image formation M2, image formation C2, and image formation K2 represent the image formation in the color image forming mode. In FIG. 3B, image formation K1 and image formation K2 represent the image formation in the monochrome image forming mode, and image formation Y3, image formation M3, image formation C3, and image formation K3 represent the image formation in the color image forming mode.

It is assumed that, in the image forming apparatus 100, the intermediate transfer belt 120 requires a time period Td to move a distance between the process unit 110Y for yellow, which is located at the most upstream position, and the process unit 110K for black, which is located at the most downstream position. The time period Td may be calculated based on the distance between the process unit 110Y for yellow, which is located at the most upstream position, and the process unit 110K for black, which is located at the most downstream position, and on the moving speed of the intermediate transfer belt 120.

Further, in the image forming apparatus 100, a time period required for the image formation preparation operation (preparation operation time period) is represented by Tp, and a time period (standby time period) corresponding to the distance of a region in which an image is not formed in a case where the images are successively formed (distance between one image and succeeding image) is represented by Ti. The standby time period (Ti) is also referred to as an inter-image time period. As described above in the section of the basic image formation operation, the time period Td is 900 milliseconds, the time period Tp is 200 milliseconds, and the time period Ti is 100 milliseconds. The present invention is not limited to those numerical values.

In all of FIG. 3A, FIG. 3B, and FIG. 3C, the image formation preparation in the monochrome image forming mode is started at a time t0 (second timing). The time t0 is a start time of the image formation preparation, and the image formation in the monochrome image forming mode is started from a time t1.

Further, a time t2 is a time after elapse of the time period Ti from a passage of the trailing edge of the last image in the image formation in the monochrome image forming mode, and the image formation for black in the color image forming mode is desired to be started at the time t2.

Therefore, a timing earlier by a total time period of (Td+Tp) from the time t2, that is, a time t3 traced back by the time period Td and the time period Tp from the time t2 is an ideal timing to start the image formation preparation in the color image forming mode because the image forming mode can be switched without loss of time. The time t2 is an ideal time to start the image formation for black, and the time t3 is an ideal time (first timing) to start the image formation preparation in the color image forming mode.

In FIG. 3A and FIG. 3B, a time period of the difference between the time t0 in the monochrome image forming mode and the ideal time t2 to start the image formation for black in the color image forming mode is equal to or longer than a time period corresponding to the total time period (Td+Tp), and hence switching can be performed without loss of time. The switching can be performed without loss of time because, in the case of FIG. 3A, the length of the last image in the monochrome image forming mode (image formation K1) is sufficiently large. Meanwhile, in the case of FIG. 3B, the switching can be performed without loss of time because, although the length of the last image in the image formation in the monochrome image forming mode (image formation K2) is not sufficient, successive printing is performed in the monochrome image forming mode.

In FIG. 3C, the time period t2-t0 of the difference between the time t0 in the monochrome image forming mode and the ideal time t2 to start the image formation for black in the color image forming mode is shorter than the time period corresponding to the total time period (Td+Tp). Therefore, there is loss of time in which no image formation is performed. In this case, the time t3 in the color image forming mode is a timing earlier than the time t0 in the monochrome image forming mode. The order of the images cannot be reversed, and hence the time t3 in the color image forming mode is set to the same time as the time t0 in the monochrome image forming mode. That is, the preparation operation is started in the image forming element located at the most upstream position at the time t0 being the second timing, and as soon as the preparation operation is completed, the image formation in the second mode is started. Therefore, there is loss in terms of time of (Td+Tp)-(t2−t0).

Figure 4:
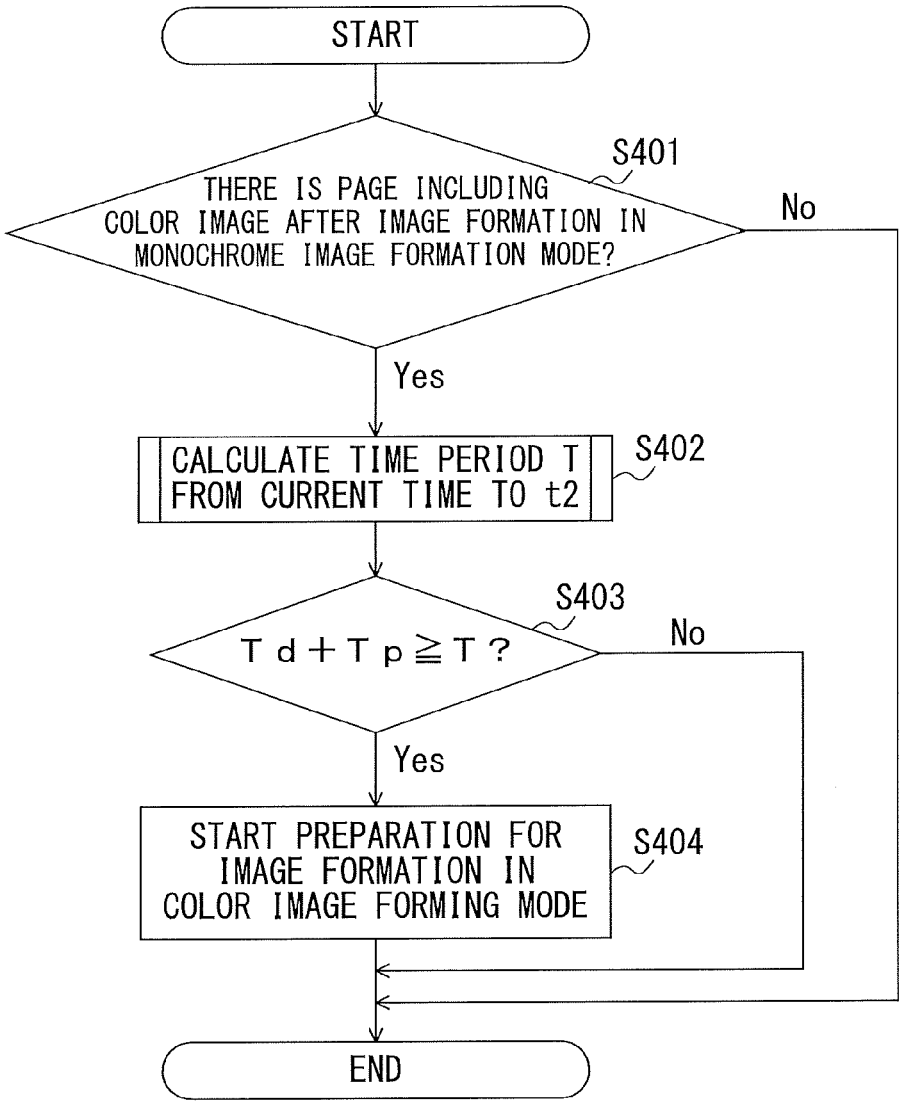
FIG. 4 is a flow chart for illustrating an example of a processing procedure for determining a timing to start image formation preparation in the color image forming mode.
Figure 5:
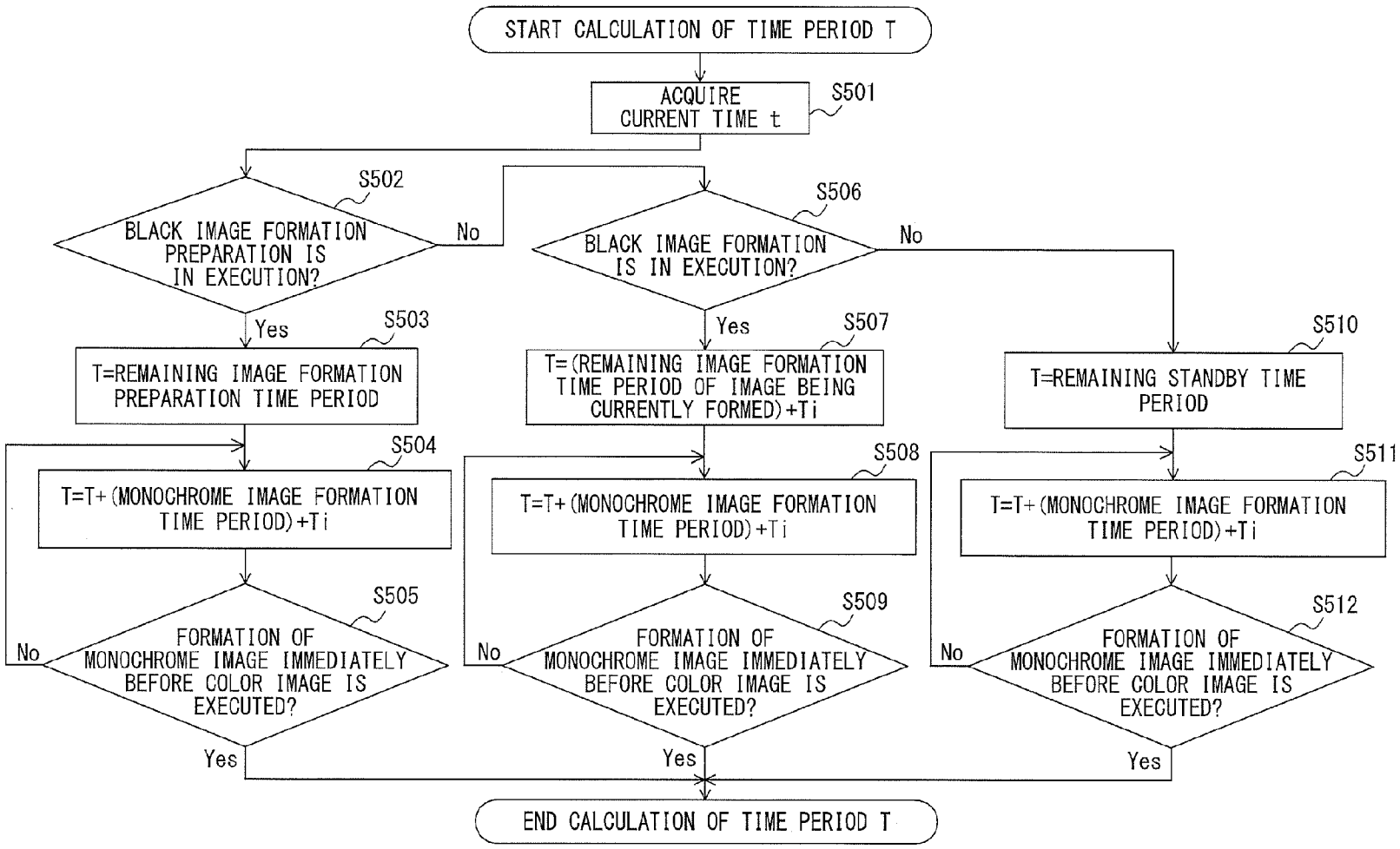
FIG. 5 is a flow chart for illustrating details of the processing of Step S402 illustrated in FIG. 4.
Figure 6:
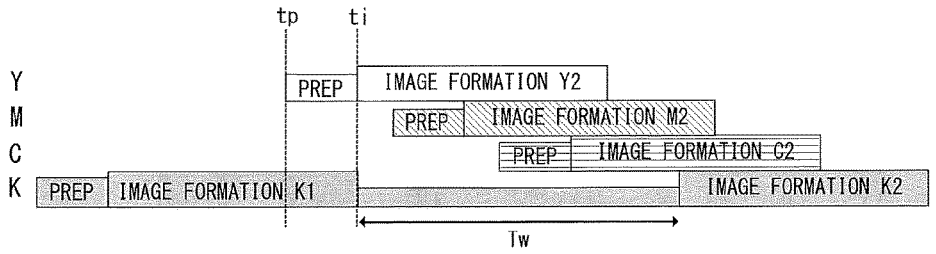
FIG. 6 PRIOR ART
FIG. 6 is a timing chart for illustrating an image forming mode switching operation of an image forming apparatus disclosed in U.S. Pat. No. 7,420,583.

FIG. 4 is a flow chart for illustrating an example of a processing procedure for determining the timing to start the image formation preparation in the color image forming mode by the image forming apparatus 100. Further, FIG. 5 is a flow chart for illustrating the details of the processing of Step S402 illustrated in FIG. 4. Each step of the processing illustrated in FIG. 5 is executed as a sub-routine in the processing procedure illustrated in FIG. 4. Further, each step of processing illustrated in FIG. 4 and FIG. 5 is mainly executed by the CPU 201.

It is assumed that the CPU 201 repeatedly executes the above-mentioned series of processing at predetermined intervals while the image forming apparatus 100 is in the monochrome image forming mode. Further, the execution interval in this case is, for example, 2-millisecond interval. It is noted that a granularity of the execution interval is only required to be a time unit that is sufficiently smaller than a given time period, for example, the time period Td, and the present invention is not limited to the above-mentioned numerical value.

With reference to FIG. 4, FIG. 3A, FIG. 3B, and FIG. 3C, description is given of the operation of determining the timing to start the image formation preparation in the color image forming mode in the image forming apparatus 100.

The CPU 201 determines whether or not the switching from the monochrome image forming mode to the color image forming mode occurs (Step S401). Specifically, in a case where the image forming apparatus 100 performs image formation in the monochrome image forming mode, and in a case where there is a page including a color image in the subsequent page, the CPU 201 determines that the switching of the image forming mode is to be performed. As described above, the CPU 201 functions as a determination means for determining whether or not the switching to the image formation in the second mode occurs after the image formation in the first mode.

Further, in a case where the CPU 201 determines that the switching from the monochrome image forming mode to the color image forming mode does not occur (Step S401: No), the processing is ended.

In a case where the CPU 201 determines that the switching from the monochrome image forming mode to the color image forming mode occurs (Step S401: Yes), the CPU 201 calculates a time period T from a current time to the ideal time T2 to start the image formation for black in the color image forming mode (Step S402). The method of calculating the time period T is described later with reference to FIG. 5.

The CPU 201 compares the magnitudes of the calculated time period T and the total time period (Td+Tp) (Step S403).

In a case where the preparation operation for the color image forming mode is immediately started when Td+Tp<T is satisfied, the process units for colors other than black are needlessly operated even after the preparation operation is completed. Therefore, in a case where the CPU 201 determines that Td+Tp<T is satisfied (Step S403: No), the CPU 201 determines that the current time point is not the timing to start the switching to the color image forming mode, and ends the processing. Further, in a case where Td+Tp≥T is satisfied (Step S403: Yes), the CPU 201 starts the image formation preparation in the color image forming mode (Step S404).

For example, in the cases illustrated in FIG. 3A and FIG. 3B, Td+Tp=T is satisfied at the time t3. Therefore, the image formation preparation in the color image forming mode is started at the time t3. Further, in the case illustrated in FIG. 3C, Td+Tp≥T is already satisfied at the time point of the time t0 in the monochrome image forming mode. Therefore, the image formation preparation in the color image forming mode is started at the time t0. The timing to start the image formation preparation in the color image forming mode is determined as described above, and thus the image forming mode can be switched at an appropriate timing without causing a time period in which the process units needlessly operate after the preparation operation is completed.

With reference to FIG. 5, FIG. 3A, FIG. 3B, and FIG. 3C, description is given of the processing of Step S402 illustrated in FIG. 4 (calculation of the time period T).

The CPU 201 acquires a current time t (Step S501). The CPU 201 determines whether or not the image formation preparation operation for black in the monochrome image forming mode is in execution (Step S502).

Whether or not the image formation preparation operation is in execution can be determined as follows. For example, in FIG. 3A, FIG. 3B, and FIG. 3C, the section from the time t0 to the time t1 corresponds to the image formation preparation operation for black in the monochrome image forming mode. Therefore, the image formation preparation operation is determined to be in execution in a case where the current time t is within this section.

In a case where the CPU 201 determines that the image formation preparation operation is in execution (Step S502: Yes), the CPU 201 sets a remaining image formation preparation time period at this time point as the value of the time period T (Step S503). The remaining image formation preparation time period is calculated based on the time period Tp, the time t0, and the current time t.

The CPU 201 repeats the processing of adding, to the time period T, the time period Ti and a time period required for image formation from the first monochrome image in the monochrome image forming mode to the monochrome image immediately before switching to the color image forming mode (Step S504). The time period required for image formation is proportional to the length of the image. The CPU 201 determines whether or not the formation of the monochrome image immediately before the color image is executed (Step S505). In a case where it is determined that the formation is executed (Step S505: Yes), the CPU 201 ends the processing. Further, in a case where it is determined that the formation is not executed (Step S505: No), the processing returns to Step S504.

As described above, the time period required from the first image formation in the first mode to the image formation immediately before switching to the second mode, which includes the standby time period (Ti) in a case where the images are successively formed, is added. The time period obtained through such addition is referred to as a first time period.

For example, in FIG. 3A and FIG. 3C, the first time period is a time period obtained by adding the time period required for image formation of one image formation K and the time period of one time period Ti. Further, in FIG. 3B, the first time period is a time period obtained by adding the time period required for the image formation of image formation K1, the time period required for the image formation of image formation K2, and the time period of two time periods Ti.

In a case where the CPU 201 determines that the image formation preparation operation is not in execution (Step S502: No), the CPU 201 determines whether or not the black image formation is in execution (Step S506).

Whether or not the black image formation is in execution is determined as follows. For example, in a case where the current time t corresponds to the section in which the black image formation is performed in FIG. 3A, FIG. 3B, and FIG. 3C, it is determined that the black image formation is in execution.

In a case where the CPU 201 determines that the black image formation is in execution (Step S506: Yes), the CPU 201 sets a value obtained by adding the time period Ti to the remaining image formation time period of the image being currently formed as the time period T (Step S507). The remaining image formation time period of the image being formed is calculated based on the time period required for the image formation of the image, the time to start forming of the image, and the current time t.

The CPU 201 repeats the processing of adding, to the time period T, the time period Ti and a time period required for image formation from a next monochrome image after an image being currently formed to the monochrome image immediately before switching to the color image forming mode (Step S508). The CPU 201 determines whether or not the formation of the monochrome image immediately before the color image is executed (Step S509). In a case where it is determined that the formation is executed (Step S509: Yes), the CPU 201 ends the processing. Further, in a case where it is determined that the formation is not executed (Step S509: No), the processing returns to Step S504.

As described above, the time period required from the next image formation in the first mode to the image formation immediately before switching to the second mode, which includes the standby time period (Ti) when the images are successively formed, is added. The time period obtained through such addition is referred to as a second time period.

For example, in a case where the image being formed at the current time is a monochrome image immediately before switching to the color image forming mode, the processing of Step S509 is ended without being executed. Further, in FIG. 3A and FIG. 3B, when the current time t corresponds to the section from the time t1 to the time t3, the operation relating to the processing of from Step S507 to Step S509 is executed.

In a case where the CPU 201 determines that the black image formation is not in execution (Step S506: No), the CPU 201 determines that the image forming operation is started but the process unit 110K for black is in a standby state without performing the image forming operation or the preparation operation, and hence the CPU 201 sets a remaining standby time period as the time period T (Step S510). The remaining standby time period may be calculated based on the time period Ti, the image formation end time, and the current time t.

The CPU 201 repeats the processing of adding, to the time period T, the time period Ti and a time period required for image formation from the monochrome image formed after elapse of the standby time period to the monochrome image immediately before switching to the color image forming mode (Step S511). The CPU 201 determines whether or not the formation of the monochrome image immediately before the color image is executed (Step S512). In a case where it is determined that the formation is executed (Step S512: Yes), the CPU 201 ends the processing. Further, in a case where it is determined that the formation is not executed (Step S512: No), the processing returns to Step S511.

As described above, the time period required from the next image formation in the first mode (image formation after elapse of the standby time period) to the image formation immediately before switching to the second mode, which includes the standby time period (Ti) when the images are successively formed, is added. The time period obtained through such addition is referred to as a third time period.

When the formation of the monochrome image immediately before the color image is ended at the current time, the processing of Step S512 is ended without being executed.

Further, although the operation of the following case is not shown in FIG. 3A, FIG. 3B, and FIG. 3C, in FIG. 3B, in a case where the length of the image corresponding to image formation K2 is larger than Td+Tp−2Ti and smaller than Td+Tp-Ti, the operation relating to the processing of from Step S510 to Step S512 is executed.

As described above, the image forming apparatus 100 according to this embodiment controls the image forming element located at the most upstream position in the color image forming mode so that this image forming element starts the image formation preparation operation before the image forming element located at the most downstream position ends the image formation in the monochrome image forming mode. With this, the downtime for switching the image forming mode can be reduced.

According to the present invention, the image forming element located at the most upstream position in the color image forming mode is controlled so that this image forming element starts the image formation preparation operation before the image forming element located at the most downstream position ends the image formation in the monochrome image forming mode. With this, the downtime for switching the image forming mode can be reduced.

The above-mentioned embodiment is given just for the purpose of describing the present invention more specifically, and the scope of the present invention is not limited by the embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-122988, filed Jun. 21, 2016 which is hereby incorporated by reference herein in its entirety.

What is claimed is:

1. An image forming apparatus, comprising:

an image forming unit comprising a plurality of image forming stations configured to form images of different colors, the image forming unit being capable of operating in a first mode of performing image formation using only a first image forming station for a predetermined color among the plurality of image forming stations, and a second mode of performing image formation using the plurality of image forming stations; and a controller configured to control the image formation in the first mode and the image formation in the second mode, wherein, in a case where the controller determines that switching to the image formation in the second mode occurs after the image formation in the first mode, the controller controls the image forming unit so that a second image forming station, which performs image formation first in the second mode among the plurality of image forming stations, starts a preparation operation of the second image forming station and the image formation by the second image forming station before the first image forming station ends the image formation in the first mode.

2. The image forming apparatus according to claim 1, wherein, in a case where the controller determines that the switching to the image formation in the second mode occurs after the image formation in the first mode, the controller controls a timing at which the second image forming station starts the preparation operation in the second mode so that the timing is set to a first timing, and wherein the first timing comprises a timing that is earlier, by a time period obtained by adding a time period corresponding to a distance between the second image forming station and the first image forming station and a time period required for the preparation operation, than a timing at which the first image forming station starts first image formation in the second mode.

3. The image forming apparatus according to claim 2, wherein, in a case where the first timing is a timing prior to a second timing at which the first image forming station starts the preparation operation in the first mode, the controller starts the preparation operation of the second image forming station at the second timing, and controls the second image forming station so that the image formation in the second mode is started as soon as the preparation operation of the second image forming station is completed.

4. The image forming apparatus according to claim 1, wherein the controller performs control so as to prevent starting of switching to the second mode when:

(1) the preparation operation of the first image forming station in the first mode is in execution; and (2) a total time period of a time period corresponding to a distance between the second image forming station and the first image forming station and a time period required for the preparation operation is shorter than a first time period, and wherein the first time period comprises a time period obtained by adding, to a remaining preparation operation time period of the first image forming station, a time period required from first image formation in the first mode to image formation immediately before switching to the second mode.

5. The image forming apparatus according to claim 4, wherein the first time period comprises a time period including an inter-image time period corresponding to a distance between one image and a succeeding image in a case where images are successively formed.

6. The image forming apparatus according to claim 4, wherein, in a case where the total time period is longer than the first time period, the controller controls the second image forming station so that the second image forming station starts the preparation operation in the second mode.

7. The image forming apparatus according to claim 1, wherein the controller performs control so as to prevent starting of switching to the second mode when:

(1) the image formation of the first image forming station in the first mode is in execution; and (2) a total time period of a time period corresponding to a distance between the second image forming station and the first image forming station and a time period required for the preparation operation is shorter than a second time period, and wherein the second time period comprises a time period obtained by adding, to a remaining image formation time period of image formation of one page in execution, an inter-image time period corresponding to a distance between one image and a succeeding image in a case where images are successively formed, and a time period required from next image formation in the first mode to image formation immediately before switching to the second mode.

8. The image forming apparatus according to claim 7, wherein the second time period comprises a time period including the inter-image time period following the next image formation in the first mode.

9. The image forming apparatus according to claim 7, wherein, in a case where the total time period is longer than the second time period, the controller controls the second image forming station so that the second image forming station starts the preparation operation in the second mode.

10. The image forming apparatus according to claim 1, wherein the controller performs control so as to prevent starting of switching to the second mode when:

(1) the image formation in the first mode is started but the first image forming station is in a standby state; and (2) a total time period of a time period corresponding to a distance between the second image forming station and the first image forming station and a time period required for the preparation operation is shorter than a second time period, and wherein the second time period comprises a time period obtained by adding, to a remaining standby time period before the first image forming station starts the image formation, a time period required from a next image formation in the first mode to image formation immediately before switching to the second mode.

11. The image forming apparatus according to claim 10, wherein the second time period comprises a time period including an inter-image time period corresponding to a distance between one image and a succeeding image in a case where images are successively formed.

12. The image forming apparatus according to claim 10, wherein, in a case where the total time period is longer than the second time period, the controller controls the second image forming station so that the second image forming station starts the preparation operation in the second mode.

13. The image forming apparatus according to claim 1, further comprising a transfer member onto which the images formed by the plurality of image forming stations are to be transferred, wherein the first image forming station is arranged at a most downstream position among the plurality of image forming stations in a moving direction of the transfer member, and wherein the second image forming station is arranged at a most upstream position among the plurality of image forming stations in the moving direction of the transfer member.

14. An image forming apparatus comprising:

an image forming unit comprising a plurality of image forming stations configured to form images of different colors, the image forming unit being capable of operating in a first mode of performing image formation using only a first image forming station for a predetermined color among the plurality of image forming stations, and a second mode of performing image formation using the plurality of image forming stations; and a controller configured to control the image formation in the first mode and the image formation in the second mode, wherein, in a case where the controller determines that switching to the image formation in the second mode occurs after the image formation in the first mode, the controller controls the image forming unit so that a second image forming station, which performs image formation first in the second mode among the plurality of image forming stations, starts a preparation operation of the image formation in the second mode before the first image forming station ends the image formation in the first mode, wherein the controller controls a timing at which the second image forming station starts the preparation operation in the second mode so that the timing is set to a first timing, and wherein the first timing comprises a timing that is earlier, by a time period obtained by adding a time period corresponding to a distance between the second image forming station and the first image forming station and a time period required for the preparation operation, than a timing at which the first image forming station starts first image formation in the second mode.

15. An image forming apparatus, comprising:

an image forming unit comprising a plurality of image forming stations configured to form images of different colors, the image forming unit being capable of operating in a first mode of performing image formation using only a first image forming station for a predetermined color among the plurality of image forming stations, and a second mode of performing image formation using the plurality of image forming stations; and a controller configured to control the image formation in the first mode and the image formation in the second mode, wherein, in a case where the controller determines that switching to the image formation in the second mode occurs after the image formation in the first mode, the controller controls the image forming unit so that each of the image forming stations of the plurality of image forming stations to be used in the second mode, excluding the first image forming station, starts a preparation operation of the image formation before the first image forming station ends the image formation in the first mode.

* * * * *